US006759795B2

(12) United States Patent
Kumagai et al.

(10) Patent No.: US 6,759,795 B2
(45) Date of Patent: Jul. 6, 2004

(54) SPARK PLUG

(75) Inventors: Kenichi Kumagai, Aichi (JP); Makoto Yamaguchi, Aichi (JP); Hiroaki Kuki, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 10/372,800

(22) Filed: Feb. 26, 2003

(65) Prior Publication Data

US 2003/0178925 A1 Sep. 25, 2003

(30) Foreign Application Priority Data

Feb. 27, 2002 (JP) ..... 2002-051313

(51) Int. Cl.[7] ..... H01T 13/20
(52) U.S. Cl. ..... 313/141; 313/144
(58) Field of Search ..... 313/141, 144

(56) References Cited

FOREIGN PATENT DOCUMENTS

| | | | |
|---|---|---|---|
| JP | 61-202743 | A | 9/1986 |
| JP | 62-50430 | A | 3/1987 |
| JP | 62-270740 | A | 11/1987 |
| JP | 63-118039 | A | 5/1988 |
| JP | 63-312939 | A | 12/1988 |
| JP | 3-134144 | A | 6/1991 |
| JP | 5-159857 | A | 6/1993 |
| JP | 6-48629 | B2 | 6/1994 |
| JP | 7-268522 | A | 10/1995 |

*Primary Examiner*—Vip Patel
(74) *Attorney, Agent, or Firm*—Sughrue Mion, PLLC

(57) ABSTRACT

A spark plug having a tubular metallic shell (1), an insulator (2) fitted into the metallic shell (1), a center electrode (3) provided in the insulator (2), and a ground electrode (4), one end of the ground electrode (4) being joined to the metallic shell (1) by means of welding or a like process, and a spark discharge gap (g) being formed between the other end portion of the ground electrode (4) and the center electrode (3), the spark plug being further characterized in that: the ground electrode (4) has an electrode base metal (4*a*), a Cu-based heat transfer acceleration element (4*c*) embedded in the electrode base metal (4*a*) and formed predominantly from Cu, and a noble metal chip (32) welded to the electrode base metal (4*a*) at a position facing the spark discharge gap (g); and the electrode base metal (4*a*) is an Ni alloy containing Cr in an amount of 14%–17% by mass, Mo in an amount of 0.8%–3.5% by mass, and Ni in an amount of 68%–85.2% by mass. In a second embodiment, the ground electrode (4) has a diffusion layer formed in a boundary between the electrode base metal (4*a*) and the Cu-based heat transfer acceleration element (4*c*), and the electrode base metal (4*a*) contains C in an amount not greater than 0.3% by mass.

18 Claims, 4 Drawing Sheets

SPARK PLUG

BACKGROUND OF THE INVENTION

1. Field of the Invention

The present invention relates to a spark plug used for providing ignition of an internal combustion engine.

2. Description of the Related Art

In recent years, in order to improve the performance of an internal combustion engine such as an automobile engine, or to cope with tightened emission gas regulations or to enhance combustion efficiency, the engine has employed lean burn, which is accompanied by a tendency toward an increase in the electrode temperature of a spark plug used for providing ignition of the engine. Particularly, a ground electrode exhibits greater temperature rise than does a center electrode, since the ground electrode is located deeper in a combustion chamber. Particularly, in the case of a spark plug for use in a direct-injection-type engine or the like, the ground electrode is more likely to exhibit marked temperature rise. Under the above-mentioned severe conditions, spark ablation of an electrode tends to be accelerated. In order to suppress the expansion rate of a spark discharge gap, a spark plug having a noble metal chip welded to a ground electrode at a portion facing a spark discharge gap has been widely used.

An increase in the temperature of a ground electrode raises a problem of high-temperature oxidation of an electrode base metal, to which a noble metal chip is welded. Conventionally, in order to attain high-temperature oxidation resistance, an Ni-based heat resistant alloy such as INCONEL 600 (INCONEL is the trade name of a product from available INCO Corp., UK) has often been used as a base metal of the ground electrode. However, the thermal conductivity of an Ni-based heat resistant alloy is generally not very high; thus, the Ni-based heat resistant alloy exhibits poor heat release and raises a problem of exhibiting a tendency toward a high rise in electrode temperature particularly in high-speed operation or the like. A rise in electrode temperature resulting from poor thermal release leads to a rise in the temperature of a metal chip joined to the electrode base metal, thereby shortening the life of the metal chip through abnormal ablation. In order to accelerate thermal release, a method has been proposed for suppressing a temperature rise of an electrode by means of disposing a core formed from a Cu-based metal (a Cu-based heat transfer acceleration element) in an electrode base metal (e.g., Japanese Patent Application Laid-Open (kokai) No. H05-159857 and Japanese Patent Publication (kokoku) No. H06-48629).

2. Problems Solved by the Invention

However, a further increase in combustion temperature and further approach of a spark portion to the center of a combustion chamber as in the case of the above-mentioned direct-injection-type engine involve a more significant increase in the temperature of a ground electrode. As a result, INCONEL 600 or a like alloy used as an electrode base metal fails to sufficiently resist high-temperature oxidation. In this case, the electrode base metal may be replaced with a metal having higher high-temperature oxidation resistance. For example, replacement of conventionally used INCONEL 600 with INCONEL 601 has been proposed. INCONEL 601 has higher Cr and Fe contents and therefore exhibits enhanced high-temperature oxidation resistance. However, such replacement of materials raises a significant problem when embedment of a Cu-based heat transfer acceleration element is to be employed.

Specifically, an electrode having a Cu-based heat transfer acceleration element is formed in the following manner: a Cu material which is to serve as the Cu-based heat transfer acceleration element is embedded in an Ni alloy material which is to serve as an electrode base metal, thereby yielding an assembly; and the assembly is subjected to cold working such as drawing, forging, or rolling, thereby yielding a clad wire material. However, a nickel-based heat resistant alloy of increased Cr content, such as INCONEL 601, exhibits high deformation resistance and low ductility as compared with INCONEL 600 or the like, as is commonly observed with a metal material whose strength is enhanced by increasing the alloying element content. Therefore, the above-mentioned process for manufacturing a clad wire material having the Cu-based heat transfer acceleration element is apt to involve cracking or a like problem, thereby raising a problem of a great reduction in yield. When a spark plug in which the Cu-based heat transfer acceleration element is embedded in the electrode base metal formed predominantly from Ni is used in an engine, a diffusion layer is formed such that metal components are diffused between the electrode base metal and the Cu-based heat transfer acceleration element. As a result of being subjected to repeated load stemming from the thermal expansion difference between the electrode base metal and the Cu-based heat transfer acceleration element, separation may arise in the diffusion layer. As a result, heat may fail to be sufficiently conducted from the electrode base metal to the Cu-based heat transfer acceleration element. When the Cu-based heat transfer acceleration element is eliminated, high-temperature oxidation of the electrode base metal can be suppressed, but the temperature rise of a noble metal chip cannot be suppressed. Thus, a problem of abnormal ablation of the chip cannot be solved.

SUMMARY OF THE INVENTION

An object of the present invention is to provide a spark plug in which sufficient high-temperature oxidation resistance is imparted to an electrode base metal of a ground electrode. The subject ground electrode has a structure including an embedded Cu-based heat transfer acceleration element exhibiting better thermal conductivity than that of the electrode base metal and is adapted to suppress a temperature rise of the electrode, the structure being able to be formed through cold working without encountering problems associated with cold working, and in which abnormal ablation of a noble metal chip joined to the electrode base metal can be prevented.

The above object of the present invention has been achieved by providing a spark plug comprising a tubular metallic shell (1), an insulator (2) fitted into the metallic shell (1), a center electrode (3) provided in the insulator (2), and a ground electrode (4), one end of the ground electrode (4) being joined to the metallic shell (1) by means of welding or a like process, and a spark discharge gap (g) being formed between the other end portion of the ground electrode (4) and the center electrode (3). The spark plug is further characterized in that the ground electrode (4) comprises an electrode base metal **(4*a*), a heat transfer acceleration element (4*c*) embedded in the electrode base metal (4*a*), formed predominantly from, for example, Cu, and exhibiting higher thermal conductivity than that of the electrode base metal (4*a*), and a noble metal chip (32) welded to the electrode base metal (4*a*) at a position facing the spark discharge gap (g). The electrode base metal (4*a*)** comprises an Ni alloy containing Cr in an amount of 14%–17% by mass, Mo in an amount of 0.8%–3.5% by mass, and Ni in an amount of 68%–85.2% by mass. Herein, the term "predominant" or "predominantly" used in relation to content means that the subject component is present in the highest content by mass.

In the above-described spark plug of the present invention, the Cu-based heat transfer acceleration element is embedded in the electrode base metal of the ground electrode so as to accelerate heat release, thereby suppressing temperature rise and thus extending the life of the ground electrode. Also, since the temperature rise of the noble metal chip welded to the electrode base metal is suppressed, abnormal ablation of the noble metal chip is prevented, thereby ensuring durability. The present invention employs an Ni alloy of the above-mentioned composition as the electrode base metal, thereby yielding the advantage described below as compared with the case of employing INCONEL 601 or the like as practiced conventionally and without encountering the above described problems of the prior art. When an Ni alloy containing C is to be employed as in the case of the present invention, addition of a certain amount of Mo together with Cr greatly enhances the high-temperature oxidation resistance of the alloy. Therefore, by virtue of employing the composition in combination with the Cu-based heat transfer acceleration element, even when the spark plug is used under severe conditions, the ground electrode can maintain sufficient durability and thus can exhibit extended life.

In this case, particularly in the case of an Ni alloy containing C, addition of Mo yields an effect of improving high-temperature corrosion resistance. The carbon may be contained as an impurity or may be intentionally added so as to enhance precipitation in the form of carbide (a so-called weak-precipitation alloy). The C content is adjusted to not greater than 0.3% by mass. Particularly, in the latter case, the C content is adjusted to, for example, 0.03%–0.3% by mass. However, when the C content is excessively high, a large amount of carbide is formed, thereby impairing cold workability. Therefore, the C content is preferably not higher than 0.10% by mass. In either case, when Mo is not added, contained C forms a carbide mainly with Cr. When such a Cr carbide is formed in a large amount, the amount of Cr, which is an element for imparting oxidation resistance, decreases as a result from precipitation of Cr in the form of Cr carbide. As a result, a passivation oxide film is insufficiently formed, leading to impairment in oxidation resistance. Particularly, when a Cr carbide is formed at a grain boundary, a Cr-deficient layer is formed in the vicinity of the grain boundary. Such formation leads to a tendency toward intergranular corrosion while the local-cell effect reinforces the development of the tendency, thereby further exerting an adverse effect on the durability of the electrode base metal.

However, when Mo is added in an appropriate amount, an Mo carbide is formed in precedence to a Cr carbide, thereby suppressing precipitation of a Cr carbide and increasing the amount of Cr contributing to formation of a passivation oxide film. As a result, even in the case where Cr content is fixed, a stronger passivation oxide film can be formed, thereby contributing to enhancement of high-temperature corrosion resistance. Also, since an Mo carbide is generally unlikely to precipitate at a grain boundary, a Cr-deficient layer is unlikely to be formed. Thus, an Mo carbide acts advantageously to suppress intergranular corrosion.

As a result, even when the Cr content is set to a relatively low level of 14%–17% by mass, the above-mentioned effect of addition of Mo implements high-temperature corrosion resistance equivalent to or higher than that exhibited by INCONEL 601 or a like alloy, which contains Cr in a higher amount. Therefore, since cold workability is improved to a degree corresponding to a reduction in the Cr content, a clad material in which a Cu-based heat transfer acceleration element is embedded and from which a ground electrode is formed can be manufactured without problem.

Even in long-hour use in an engine, the addition of Mo can yield the effect of suppressing an increase in the thickness of a diffusion layer formed in the boundary between the electrode base metal and the Cu-based heat transfer acceleration element, thereby preventing separation in the diffusion layer. Conceivably, low ductility of an alloy of Ni and Cu contained predominantly in the diffusion layer may be related to the occurrence of the separation.

When the Cr content of an Ni alloy serving as the electrode base metal is less than 14% by mass, the high-temperature oxidation resistance of the electrode base metal becomes insufficient, thereby shortening electrode life. When the Cr content is in excess of 17% by mass, workability is impaired, resulting in a tendency toward the occurrence of cracking or the like in the course of manufacturing a clad material in which a Cu-based heat transfer acceleration element is embedded and from which a ground electrode is formed.

When the Mo content is less than 0.8% by mass, addition of Mo poorly yields an effect of improving high-temperature oxidation resistance and an effect of preventing separation in the diffusion layer in long-hour use. When the Mo content is in excess of 3.5% by mass, the hardness of a resultant alloy increases, thereby increasing deformation resistance and thus leading to impaired workability. When the Ni content is less than 68% by mass, the accessory-component content becomes excessively high, resulting in a tendency toward impaired workability or the like. When the Ni content is in excess of 85.2% by mass, the required Cr and Mo contents cannot be attained, thereby leading to impaired high-temperature oxidation resistance.

In view of ensuring weldability, or weld strength, in welding a ground electrode to a metallic shell, preferably, an Ni alloy serving as the electrode base metal has an Al content less than 1% by mass. When the Al content is not less than 1% by mass, aluminum oxide is excessively formed, thereby potentially impairing weldability or weld strength. For the purpose of enhancing high-temperature oxidation resistance, Al can be intentionally added within the above-mentioned range.

Fe can be added to an Ni alloy serving as the electrode base metal. Fe forms a solid solution containing Fe and Ni in order to increase the strength of the alloy to thereby enhance its high-temperature strength. Preferably, the Fe content is adjusted to 6%–10% by mass. When the Fe content is less than 6% by mass, the contained Fe falls to yield a sufficient effect of enhancing high-temperature strength. When the Fe content is in excess of 10% by mass, high-temperature oxidation resistance may fail to be sufficiently attained.

DESCRIPTION OF REFERENCE NUMERALS

Figure 1:
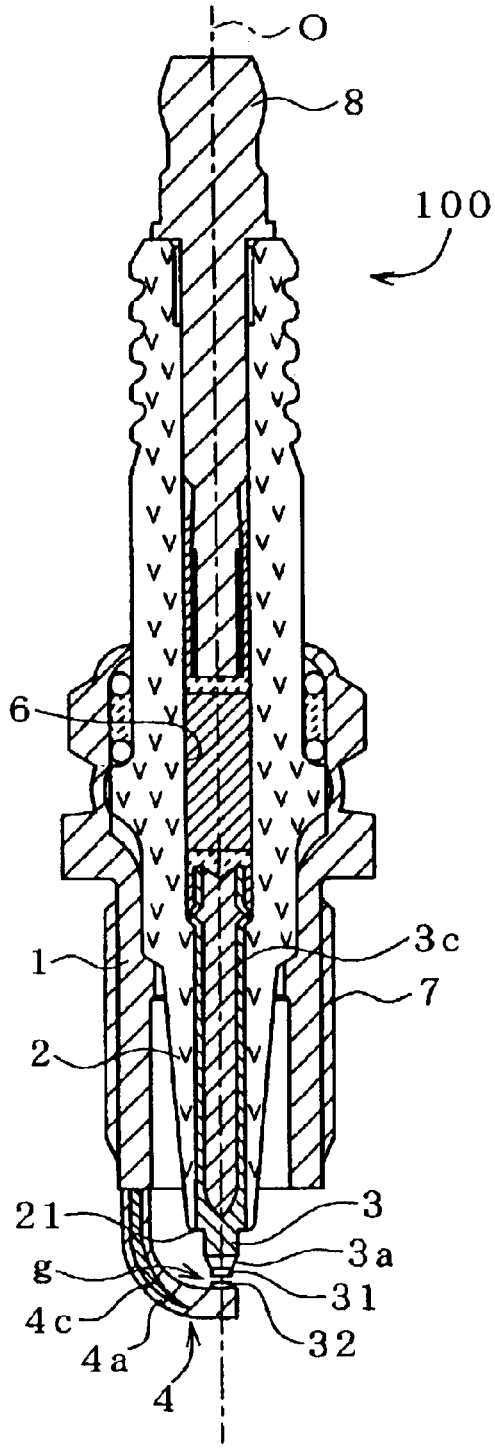
FIG. 1 is a vertical sectional view showing a spark plug according to an embodiment of the present invention.

1: metallic shell
2: insulator
21: distal end portion
3: center electrode
32: noble metal chip
4: ground electrode

4*a*: electrode base metal
4*c*: Cu-based heat transfer acceleration element
100: spark plug

DESCRIPTION OF THE PREFERRED EMBODIMENTS

Modes for carrying out the present invention will next be described with reference to the accompanying drawings. However, the present invention should not be construed as being limited thereto.

FIG. 1 is a vertical sectional view showing a spark plug 100 according to an embodiment of the present invention. The spark plug 100 includes a tubular metallic shell 1, an insulator 2 which is fitted into the metallic shell 1 such that a distal end portion 21 projects from the metallic shell 1, a center electrode 3 provided in the insulator 2, and a ground electrode 4 whose one end is joined to the metallic shell 1 by means of welding or a like process and whose other end portion and the center electrode 3 form a spark discharge gap g therebetween. The spark plug 100 of the present embodiment is of a so-called parallel-electrode type; i.e., a distal end portion of the ground electrode 4 is bent laterally such that the spark discharge gap g is formed between the side surface of the distal end portion and the distal end face of the metallic shell 1. Noble metal chips 31 and 32 formed from a Pt alloy or an Ir alloy are welded to the center electrode 3 and the ground electrode 4, respectively, at positions facing the spark discharge gap g.

The insulator 2 is formed from a ceramic sintered body such as alumina or aluminum nitride. The insulator 2 has a hole portion 6 formed therein along the direction of its axis O and is adapted to receive the center electrode 3 and a metallic terminal member 8. The metallic shell 1 is formed into a tubular shape from a metal such as low-carbon steel and serves as a housing of the spark plug 100. A male-threaded portion 7 is formed on the outer circumferential surface of the metallic shell 1 and is adapted to mount the spark plug 100 on an unillustrated engine block.

Figure 2:
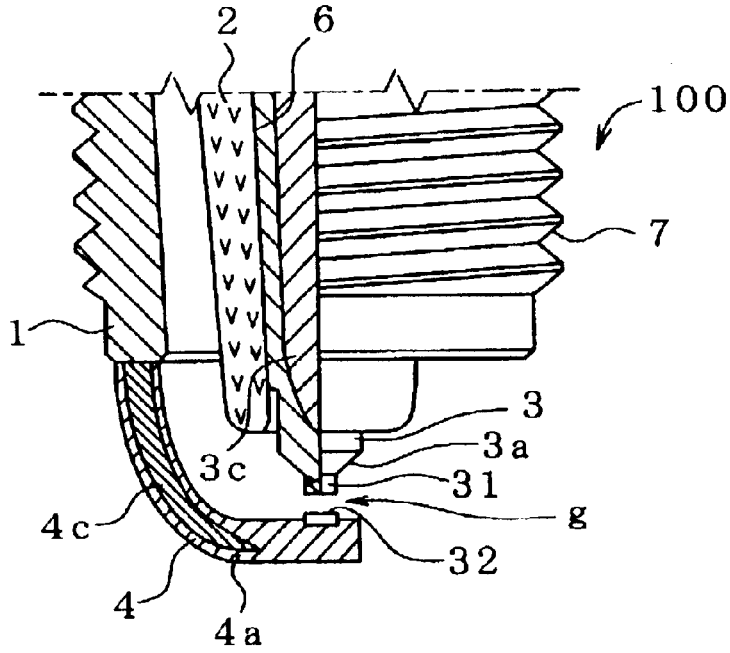
FIG. 2 is an enlarged sectional view showing essential portions of the spark plug of FIG. 1.

As shown in FIG. 2, the ground electrode 4 includes an electrode base metal 4*a* used to form its outer surface portion, and a Cu-based heat transfer acceleration element 4*c* embedded in the electrode base metal 4*a*. The electrode base metal 4*a* is an Ni alloy which contains Cr in an amount of 14%–17% by mass, Mo in an amount of 0.8%–3.5% by mass, and Ni in an amount of 68%–85.2% by mass. The Cu-based heat transfer acceleration element 4*c* is formed from pure Cu or a Cu alloy. In the present embodiment, the Cu-based heat transfer acceleration element 4*c* is disposed in the ground electrode 4 along the longitudinal direction of the ground electrode 4. The Cu-based heat transfer acceleration element 4*c* tapers toward its distal end. The distal end is located off a position corresponding to the spark discharge gap g, for the reason described below. A distal end portion of the ground electrode 4 which serves to form the spark discharge gap g exhibits a great temperature rise. If the Cu-based heat transfer acceleration element 4*c* extends to the distal end portion of the ground electrode 4, the difference of linear expansion coefficient between the Cu-based heat transfer acceleration element 4*c* and the electrode base metal 4*a* may result in swelling of the ground electrode 4 or layer separation. A preferred distance between the distal end of the Cu-based heat transfer acceleration element 4*c* and the axis O of the center electrode 3 is 1.5–3.0 mm (2.0 mm in this embodiment).

In the present embodiment, the center electrode 3 also includes an electrode base metal 3*a* and a Cu-based heat transfer acceleration element 3*c* embedded in the electrode base metal 3*a*. The electrode base metal 3*a* can be the same Ni alloy as that used in the ground electrode 4. However, since the temperature of the center electrode 3 is less likely to rise than that of the ground electrode 4, the electrode base metal 3*a* can be such that the Mo content is lower than that of the electrode base metal 4*a* of the ground electrode 4 (or Mo is not contained), and the Cr content is equivalent to or lower than that of the electrode base metal 4*a*.

Figure 4:
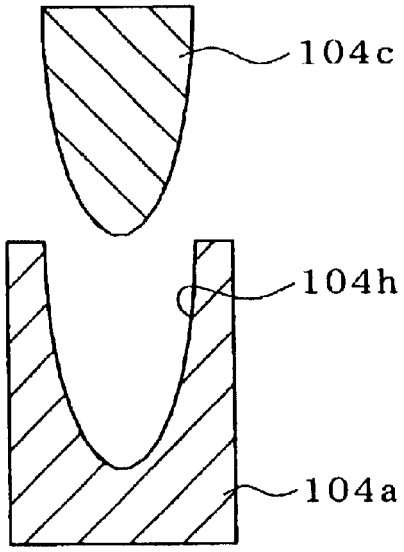
FIGS. 4(*a*)–4(*d*) are explanatory views showing the steps of manufacturing a ground electrode of the spark plug of FIG. 1.
Figure 4:
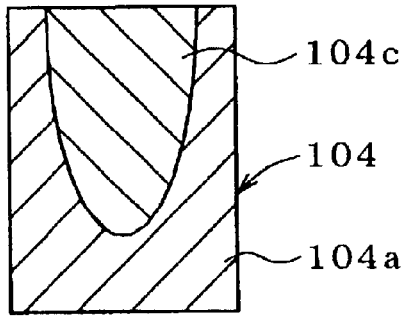
Figure 4:
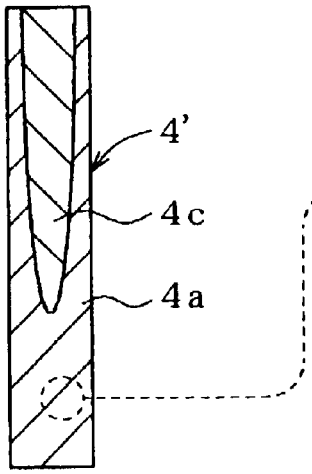
Figure 4:
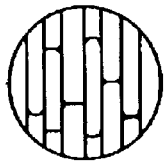

FIG. 4 shows an example method for manufacturing the ground electrode 4. Specifically, as shown in FIG. 4(*a*), an Ni-based preform 104*a* having a cavity 104*h* formed therein is formed from an Ni alloy—which is a material for the electrode base metal 4*a*—by means of cutting or plastic working such as deep drawing. A Cu-based preform 104*c* whose shape corresponds to that of the cavity 104*h* is formed from pure Cu (e.g., oxygen-free copper) or a Cu alloy, which is a material for the Cu-based heat transfer acceleration element 4. The Cu-based preform 104*c* is fitted into the cavity 104*h* of the Ni-based preform 104*a*, thereby yielding an assembly 104 of FIG. 4(*b*).

Next, as shown in FIG. 4(*c*), the assembly 104 is subjected to die drawing, forging, or rolling at room temperature so as to have a reduced cross-sectional area or is elongated, to thereby form a clad wire material 4'. Thus, the Cu-based preform 104*c* becomes the Cu-based heat transfer acceleration element 4*c*; and the Ni-based preform 104*a* becomes the electrode base metal 4*a*. An end of the clad wire material 4' where the Cu-based heat transfer acceleration element 4*c* is exposed is welded to the metallic shell 1 (FIG. 2). Then, the welded clad wire material 4' is bent, thereby completing the ground electrode 4.

Since the Cr content is reduced as mentioned above, the Ni alloy used to form the Ni-based preform 104*a* exhibits good workability and thus can be formed into the clad wire material 4' by means of cold working at room temperature or hot working at a temperature not higher than 900° C., without problem such as cracking. Further, in compensation for reducing the Cr content, Mo is contained in an amount of the aforementioned range. Thus, in terms of high-temperature corrosion resistance, the Ni alloy compares favorably with an Ni-based heat resistant alloy of high Cr content, such as INCONEL 601, thereby greatly extending the life of the ground electrode. Further, since the Cu-based heat transfer acceleration element 4*c* can be readily incorporated and since, even in long-use in an engine, separation does not arise in the diffusion layer, a temperature rise of the noble metal chip 32 is suppressed, thereby suppressing abnormal ablation of the noble metal chip 32 and thus ensuring durability.

When the ground electrode 4 is manufactured by means of cold working, as shown in FIG. 4(*d*), the electrode base metal 4*a* exhibits a microstructure in which crystal grains are elongated in the longitudinal direction of the electrode. Notably, when the as-cold-worked clad wire material 4' is annealed, metal components diffuse between the Cu-based heat transfer acceleration element 4*c* and the electrode base metal 4*a* formed from an Ni alloy, thereby enhancing the joining force therebetween. This annealing may be performed before cold working or after cold working. When annealing is performed at high temperature after cold working, the microstructure of FIG. 4(*d*), in which crystal grains are elongated, may change to a microstructure in which crystal grains are grown.

Figure 3:
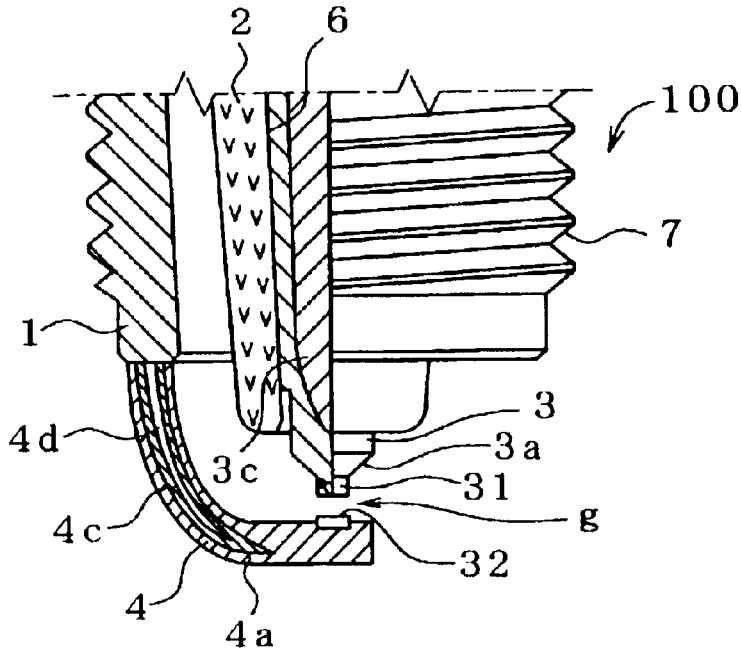
FIG. 3 is a sectional view showing essential portions of a modified embodiment of the spark plug of FIG. 1.

As shown in FIG. 3, an Ni-based expansion adjustment layer 4*d* formed from pure Ni or an Ni alloy may be disposed inside the Cu-based heat transfer acceleration element 4*c*. Since the linear expansion coefficient differs greatly between the electrode base metal 4*a* of an Ni alloy and the Cu-based heat transfer acceleration element 4*c*, particularly, exposure to severe thermal cycles is apt to raise the swelling of the electrode, resulting in layer separation, or the like. However, formation of the above-mentioned Ni-based expansion adjustment layer 4*d* reduces the thickness of the Cu-based heat transfer acceleration element 4*c* and establishes the condition of sandwiching the Cu-based heat transfer acceleration element 4*c* between the Ni-based metals (the Ni-based expansion adjustment layer 4*d* and the electrode base metal 4*a*), thereby suppressing the occurrence of the above-mentioned problems. To effectively prevent electrode swelling or layer separation, the linear expansion coefficient of the expansion adjustment layer is set to be smaller than that of said electrode base material.

Figure 5:
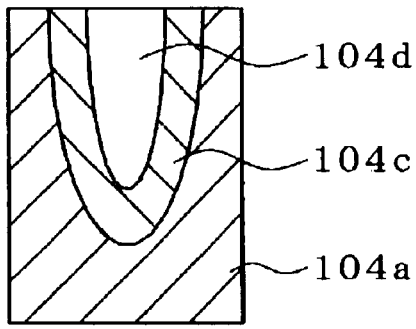
FIGS. 5(*a*)–5(*b*) are explanatory views showing the steps of manufacturing a ground electrode of the spark plug of FIG. 3.
Figure 5:
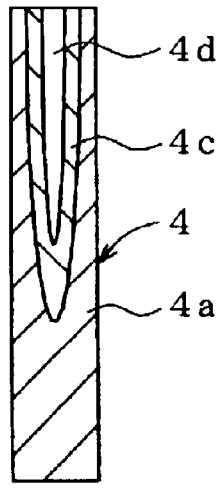

FIGS. 5(*a*) and 5(*b*) show an example method for manufacturing the ground electrode 4. An Ni-based preform 104*a* having a cavity formed therein is formed from an Ni alloy—which is a material for the electrode base metal 4*a*—by means of cutting or plastic working such as deep drawing. A Cu-based preform 104*c* whose shape corresponds to that of the cavity of the Ni-based perform 104*a* is formed from pure Cu (e.g., oxygen-free copper) or a Cu alloy, which is a material for the Cu-based heat transfer acceleration element 4. A Ni-based preform 104*d* whose shape corresponds to that of the cavity of the Cu-based perform 104*c* is formed from pure Ni (e.g., oxygen-free nickel) or a Ni alloy, which is a material for the Ni-based expansion adjustment layer 4*d*. The Cu-based preform 104*c* is fitted into the cavity of the Ni-based preform 104*a*, the Ni-based preform 104*d* is fitted into the cavity of the Cu-based preform 104*c*, thereby yielding the assembly of FIG. 5(*a*).

Next, as shown in FIG. 5(*b*), the assembly is subjected to die drawing, forging, or rolling at room temperature so as to have a reduced cross-sectional area or is elongated, to thereby form a clad wire material 4'. Thus, the Ni-based perform 104*d* becomes the Ni-based expansion adjustment layer 4*d*; the Cu-based preform 104*c* becomes the Cu-based heat transfer acceleration element 4*c*; and the Ni-based preform 104*a* becomes the electrode base metal 4*a*.

EXAMPLES

In order to confirm the effect of the present invention, the experiments described below were carried out. The following Examples should not be construed as limiting the invention.

Various samples of the spark plug 100 shown in FIG. 1 were manufactured. The ground electrodes 4 were manufactured by the method of FIG. 4. Specifically, Ni alloys of various compositions shown in Table 1 were prepared to form electrode base metals. Ni-based preforms 104*a* to be formed into the corresponding electrode base metals 4*a* were each manufactured so as to assume an outside diameter of 4.5 mm and a length of 5.4 mm. Cu-based preforms 104*c* to be formed into the corresponding Cu-based heat transfer acceleration elements 4*c* were each manufactured from oxygen-free copper so as to assume an exposed-end diameter of 2.9 mm and a length of 5 mm. The Cu-based preforms 104*c* were fitted into the corresponding cavities 104*h* formed in the Ni-based preforms 104*a*, thereby yielding the assemblies 104. The assemblies 104 were subjected to cold extrusion such that the cross-sectional-area reduction rate per pass was 55%, thereby yielding wire materials each having a rectangular cross section measuring 1.5 mm×2.8 mm and a length of 19 mm. For comparison, a ground electrode of composition No. 1 were manufactured such that the Cu-based heat transfer acceleration element 4*c* was eliminated (No. 12).

The thus-manufactured ground electrodes were evaluated for workability in accordance with the following criteria:

Good (O): Cold working was carried out without problem; i.e., no cracking or separation was observed in a boundary region between the electrode base metal 4*a* and the Cu-based heat transfer acceleration element 4*c*.

Acceptable (Δ): Cracking or separation was observed in a boundary region between the electrode base metal 4*a* and the Cu-based heat transfer acceleration element 4*c*. However, the problem was fixed by carrying out cold working after the assembly was annealed at 930° C. for one hour.

Unacceptable (x): The problem was not fixed even by annealing the assembly at 930° C. for one hour (a ground electrode free of the problem was obtained by means of hot protrusion at a temperature of 730° C.).

The ground electrodes thus obtained were subjected to a high-temperature fatigue test under the conditions described below. The test was carried out using an axial-load fatigue tester under the following conditions: temperature: 600° C.; stress amplitude: ±900N tension/compression; and repetition cycle: 10 Hz. Fatigue strength for finite life was obtained by the method specified in JIS Z2273 (1978) with the number N of test pieces set to 2 and fatigue life set to $10^6$ cycles, and was evaluated in accordance with the following criteria (confirmation of high-temperature breakage resistance):

Good (O): Fatigue strength for finite life is not less than 220 MPa.

Acceptable (Δ): Fatigue strength for finite life is not less than 200 MPa and less than 220 MPa.

Unacceptable (x): Fatigue strength for finite life is less than 200 MPa.

The center electrodes 3 were manufactured by means of cold protrusion similar to that used to manufacture the ground electrodes 4, such that the electrode base metal 3*a* was INCONEL 600, and the Cu-based heat transfer acceleration element 3*c* was formed from oxygen-free copper, and in such a manner as to assume a length of 24 mm and a circular cross section having a diameter of 2.5 mm.

The noble metal chip 32 was resistance-welded to each of the ground electrodes 4. The noble metal chip 32 was formed from a Pt-10% by mass Ni alloy and assumed a disklike shape having a diameter of 0.9 mm and a thickness of 0.4 mm. The noble metal chip 31 was resistance-welded to each of the center electrodes 3. The noble metal chip 32 was formed from a Pt-13% by mass Ir alloy and assumed a disklike shape having a diameter of 0.8 mm and a thickness of 0.6 mm. Each of the center electrodes 3 was attached to the corresponding insulator 2 of alumina. To the insulators 2, the corresponding metallic shells 1 having the ground electrode 4 welded thereto were attached. The ground electrodes 4 were bent so as to form a spark discharge gap g of 0.9 mm between the noble metal chips 31 and 32.

The spark plug samples which were manufactured by the above-described method were tested as described below. Notably, the ground electrodes which were to be tested by use of an engine as described below were annealed for one hour at 930° C. so as to form a diffusion layer having a thickness of 10–20 μm between the Cu-based heat transfer acceleration element 4*c* and the electrode base metal 4*a*. The thickness of the diffusion layer to be formed through annealing between the electrode base metal and the heat transfer acceleration element is preferably 5–30 μm.

The spark plugs were mounted on a 4-cylinder gasoline engine (piston displacement 2,000 cc) and were subjected to a 250-hour continuous operation test at an engine speed of 6,000 rpm in the throttle full-admission state (estimated temperature of noble metal chip 32 of ground electrode: about 1,000° C.). After the test, the cross section of each of the ground electrodes 4 was observed using a scanning electron microscope, whereby the thickness of a formed oxide scale layer was measured and evaluated in accordance with the following criteria (confirmation of high-temperature oxidation resistance of ground electrode):

Good (O): Oxide scale layer thickness less than 0.05 mm

Acceptable (Δ): Oxide scale layer thickness not less than 0.05 mm and less than 0.15 mm Unacceptable (x): Oxide scale layer thickness not less than 0.15 mm After the test, the ablated thickness of the noble metal chip of each of the ground electrodes was measured in the gap direction and was evaluated in accordance with the following criteria (confirmation of durability of noble metal chip):

Good (O): Ablated thickness less than 0.3 mm

Acceptable (Δ): Ablated thickness not less than 0.3 mm and less than 0.35 mm

Unacceptable (x): Ablated thickness not less than 0.35 mm

The weld strength between the ground electrode 4 and the metallic shell 1 was tested by a tensile test and a bending test. Specifically, the tensile test was carried out in the following manner: the metallic shell 1 and a distal end portion (at a position located 5 mm away from the distal end) of the ground electrode 4 (before being bent) were gripped and pulled away from each other in the axial direction of the ground electrode 4. The bending test was carried out in the following manner: while the metallic shell 1 was gripped, a predetermined bending load was repeatedly applied to the ground electrode 4 at a position located 5 mm away from the end face of the metallic shell 1, perpendicularly to the axial direction of the ground electrode 4, until the ground electrode 4 was broken. The test results were evaluated in accordance with the following criteria (confirmation of weldability):

Good (O): The weld zone does not break in either of the tensile test and the bending test.

Acceptable (Δ): The weld zone does not break in the tensile test, but breaks in the bending test.

Unacceptable (x): The weld zone breaks in both of the tensile test and the bending test.

After the test, the ground electrodes 4 were observed with X rays, and the cross section of each of the ground electrodes 4 was observed with a scanning electron microscope, whereby the diffusion layer was checked for occurrence of separation, and the thickness of the diffusion layer was measured. The results were evaluated in accordance with the following criteria (confirmation of separation resistance of heat transfer acceleration element of ground electrode):

Good (O): The Cu-based heat transfer acceleration element 4*c* and the electrode base metal 4*a* are not separated from each other, and the thickness of the diffusion layer is not greater than 50 μm.

Acceptable (Δ): The Cu-based heat transfer acceleration element 4*c* and the electrode base metal 4*a* are not separated from each other, but the thickness of the diffusion layer is not less than 50 μm.

Unacceptable (x): The Cu-based heat transfer acceleration element 4*c* and the electrode base metal 4*a* are separated from each other.

The test results are shown in Table 1.

TABLE 1

| | Composition of alloy (% by mass) | | | | | | | | High-temp. oxidation | Electrode | High-temp. breakage | | Noble metal chip | Separation resistance of heat transfer acceleration |
|---|---|---|---|---|---|---|---|---|---|---|---|---|---|---|
| | Ni | Cr | Mo | Al | Fe | Mn | Si | C | resistance | workability | resistance | Weldability | durability | element |
| 1* | 67.75* | 23* | 0* | 0.5 | 8 | 0.5 | 0.2 | 0.05 | ○ | X | X | ○ | Δ | X |
| 2* | 74.5 | 16 | 0.45* | 0.3 | 8 | 0.5 | 0.2 | 0.05 | X | ○ | Δ | ○ | Δ | Δ |
| 3 | 74.15 | 16 | 0.8 | 0.3 | 8 | 0.5 | 0.2 | 0.05 | ○ | ○ | ○ | ○ | ○ | ○ |
| 4 | 72.95 | 16 | 2.0 | 0.3 | 8 | 0.5 | 0.2 | 0.05 | ○ | ○ | ○ | ○ | ○ | ○ |
| 5 | 71.95 | 16 | 3.0 | 0.3 | 8 | 0.5 | 0.2 | 0.05 | ○ | ○ | ○ | ○ | ○ | ○ |
| 6* | 69.95 | 16 | 5.0* | 0.3 | 8 | 0.5 | 0.2 | 0.05 | ○ | X | ○ | ○ | ○ | ○ |
| 7* | 76.95 | 12* | 2.0 | 0.3 | 8 | 0.5 | 0.2 | 0.05 | X | ○ | ○ | ○ | Δ | ○ |
| 8 | 72.15 | 16 | 2.0 | 1.1 | 8 | 0.5 | 0.2 | 0.05 | ○ | ○ | ○ | Δ | ○ | ○ |
| 9 | 75.15 | 16 | 2.0 | 1.1 | 5 | 0.5 | 0.2 | 0.05 | ○ | ○ | ○ | Δ | ○ | ○ |
| 10 | 70.15 | 14 | 2.0 | 1.1 | 12 | 0.5 | 0.2 | 0.05 | ○ | ○ | ○ | Δ | ○ | ○ |
| 11* | 90.95* | 5* | 3.0 | 0.3 | 0 | 0.5 | 0.2 | 0.05 | X | ○ | Δ | ○ | X | ○ |
| 12* | 67.95* | 23* | 0* | 0.3 | 8 | 0.5 | 0.2 | 0.05 | X | — | ○ | ○ | X | — |

Samples marked with * fall outside the scope of the invention. In Sample No. 12, the Cu-based heat transfer acceleration element is not provided.

Example Nos. 3, 4, 5, 8, 9, and 10 are spark plugs of the present invention in which the electrode base metal is an Ni alloy containing Cr in an amount of 14%–17% by mass, Mo in an amount of 0.8%–3.5% by mass, and Ni in an amount of 68%–85.2% by mass. In the spark plugs of the present invention, in compensation for reducing the Cr content, Mo is added in an amount of the above-mentioned range. Therefore, even though the electrode base metals of these Examples of the present invention contain C, the Examples of the present invention compare favorably in high-temperature oxidation resistance with Comparative Example No. 1 of high Cr content. Because of relatively low Cr content, the Examples exhibit better electrode workability than does Comparative Example No. 1, thereby allowing embedment of the Cu-based heat transfer acceleration element without problem. Since embedment of the Cu-based heat transfer acceleration element improves heat release, good noble-metal-chip durability is exhibited. Since addition of Mo significantly enhances high-temperature strength, good high-temperature breakage resistance is exhibited. Further, even in long-hour use in an engine, an increase in the thickness of the diffusion layer can be suppressed, and no separation arises in the diffusion layer. By contrast, Comparative Example No. 1 in which Mo is not added exhibits poor cold workability; therefore, embedment of the Cu-based heat transfer acceleration element requires troublesome hot working. Also, high-temperature breakage resistance is rather poor, and separation has occurred in the diffusion layer. As in the case of Comparative Example No. 12, when the Cu-based heat transfer acceleration element is eliminated, high-temperature oxidation resistance and noble-metal-chip durability are significantly impaired.

It should further be apparent to those skilled in the art that various changes in form and detail of the invention as shown and described above may be made. It is intended that such changes be included within the spirit and scope of the claims appended hereto.

This application is based on Japanese Patent Application No. 2002-51313 filed Feb. 27, 2002, incorporated herein by reference in its entirety.

What is claimed is:

1. A spark plug comprising a tubular metallic shell, an insulator fitted into said metallic shell, a center electrode provided in said insulator, and a ground electrode, one end of said ground electrode being joined to said metallic shell, and a spark discharge gap being formed between the other end portion of said ground electrode and said center electrode, said spark plug being further characterized in that:

said ground electrode comprises an electrode base metal, a Cu-based heat transfer acceleration element embedded in said electrode base metal and formed predominantly from Cu, and a noble metal chip welded to said electrode base metal at a position facing said spark discharge gap; and said electrode base metal comprises an Ni alloy containing Cr in an amount of 14%–17% by mass, Mo in an amount of 0.8%–3.5% by mass, and Ni in an amount of 68%–85.2% by mass.

2. A spark plug comprising a tubular metallic shell, an insulator fitted into said metallic shell, a center electrode provided in said insulator, and a ground electrode, one end of said ground electrode being joined to said metallic shell, and a spark discharge gap being formed between the other end portion of said ground electrode and said center electrode, said spark plug being further characterized in that:

said ground electrode comprises an electrode base metal, a Cu-based heat transfer acceleration element embedded in said electrode base metal and formed predominantly from Cu, a diffusion layer formed in a boundary between said electrode base metal and said Cu-based heat transfer acceleration element, and a noble metal chip welded to said electrode base metal at a position facing said spark discharge gap; and said electrode base metal is an Ni alloy containing C in an amount not greater than 0.3% by mass, Cr in an amount of 14%–17% by mass, Mo in an amount of 0.8%–3.5% by mass, and Ni in an amount of 68%–85.2% by mass.

3. The spark plug as claimed in claim 1, wherein said Ni alloy serving as said electrode base metal has an Al content less than 1% by mass.

4. The spark plug as claimed in claim 2, wherein said Ni alloy serving as said electrode base metal has an Al content less than 1% by mass.

5. The spark plug as claimed in claim 1, wherein said Ni alloy serving as said electrode base metal has an Fe content of 6%–10% by mass.

6. The spark plug as claimed in claim 2, wherein said Ni alloy serving as said electrode base metal has an Fe content of 6%–10% by mass.

7. The spark plug as claimed in claim 1, wherein a distal end of said Cu-based heat transfer acceleration element is located off a position corresponding to said spark discharge gap.

8. The spark plug as claimed in claim 2, wherein a distal end of said Cu-based heat transfer acceleration element is located off a position corresponding to said spark discharge gap.

9. The spark plug as claimed in claim 1, wherein an Ni-based expansion adjustment layer formed from pure Ni or an Ni alloy is disposed inside said Cu-based heat transfer acceleration element.

10. The spark plug as claimed in claim 2, wherein an Ni-based expansion adjustment layer formed from pure Ni or an Ni alloy is disposed inside said Cu-based heat transfer acceleration element.

11. The spark plug as claimed in claim 1, wherein said noble metal chip is formed from a Pt—Ni alloy.

12. The spark plug as claimed in claim 2, wherein said noble metal chip is formed from a Pt—Ni alloy.

13. The spark plug as claimed in claim 1, wherein a diffusion layer having a thickness of 5–30 $\mu$m is present between said electrode base metal and said Cu-based heat transfer acceleration element.

14. The spark plug as claimed in claim 2, wherein a diffusion layer having a thickness of 5–30 $\mu$m is present between said electrode base metal and said Cu-based heat transfer acceleration element.

15. A spark plug comprising a tubular metallic shell, an insulator fitted into said metallic shell, a center electrode having a longitudinal axis provided in said insulator, and a ground electrode, one end of said ground electrode being joined to said metallic shell, and a spark discharge gap being formed between the other end portion of said ground electrode and said center electrode, said spark plug being further characterized in that:

said ground electrode comprises an electrode base metal, a heat transfer acceleration element embedded in said electrode base metal and adapted to suppress temperature rise of said ground electrode, and a noble metal chip welded to said electrode base metal at a position facing said spark discharge gap; and said electrode base metal is an Ni alloy containing C in an amount not greater than 0.3% by mass, Cr in an amount of 14%–17% by mass, Mo in an amount of 0.8%–3.5% by mass, and Ni in an amount of 68%–85.2% by mass.

16. The spark plug as claimed in claim 15, wherein a distal end of said Cu-based heat transfer acceleration element is laterally spaced from a longitudinal axis of the center electrode passing through the spark discharge gap.

17. The spark plug as claimed in claim 15, wherein a distance between a distal end of the heat transfer acceleration element and the axis of the center electrode is set within a range of 1.5 mm to 3.0 mm.

18. The spark plug as claimed in claim 15, comprising an expansion adjustment layer disposed inside said heat transfer acceleration element, said expansion adjustment layer having a linear expansion coefficient which is smaller than that of said electrode base material.

* * * * *